US008322717B1

(12) United States Patent
de Jong et al.

(10) Patent No.: US 8,322,717 B1
(45) Date of Patent: Dec. 4, 2012

(54) MOTION QUALITY BY HANDOFF FORCE CONTROL BETWEEN UPSTREAM AND DOWNSTREAM TRANSPORTS

(75) Inventors: Joannes N. M. de Jong, Hopewell Junction, NY (US); Steven R. Moore, Pittsford, NY (US); Peter J. Knausdorf, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/337,359

(22) Filed: Dec. 27, 2011

(51) Int. Cl.
*B65H 7/02* (2006.01)

(52) U.S. Cl. ..... 271/264; 271/258.01; 271/265.01

(58) Field of Classification Search ..... 271/264, 271/258.01, 265.01, 275, 69, 176, 198
See application file for complete search history.

(56) References Cited

U.S. PATENT DOCUMENTS

| | | | | |
|---|---|---|---|---|
| 5,335,043 | A * | 8/1994 | Kluger et al. | 399/16 |
| 2003/0085512 | A1 * | 5/2003 | Middelberg et al. | 271/226 |
| 2008/0006995 | A1 * | 1/2008 | Nonaka | 271/265.01 |
| 2010/0118099 | A1 * | 5/2010 | Ito | 347/104 |

* cited by examiner

*Primary Examiner* — David H Bollinger
(74) *Attorney, Agent, or Firm* — Hoffmann & Baron, LLP

(57) ABSTRACT

A media transport apparatus includes a first media transport, having a first transport surface and a first drive unit, to convey the substrate media. A second media transport having a second transport surface and a second drive unit receives the substrate media from the first. A first force transducer outputs a force signal associated with a first force between the media transports. A control unit receives the force signal, and outputs a control signal to at least one of the first and second drive units that is dependent upon a comparison of the first relative force signal with a predetermined value. The control signal commands the first or second drive unit to drive the motion of the respective first or second media transport to maintain the force signal at or about no greater than the predetermined value.

33 Claims, 4 Drawing Sheets

MOTION QUALITY BY HANDOFF FORCE CONTROL BETWEEN UPSTREAM AND DOWNSTREAM TRANSPORTS

BACKGROUND

1. Field of the Disclosure

The present disclosure relates to methods of document creation. More specifically, the present disclosure is directed to a system and method for substrate media handling in a marking station providing a high motion quality transfer of the substrate media from the marking zone to downstream handling apparatus.

2. Brief Discussion of Related Art

In direct-marking print applications, particularly those using stationary print heads, high motion quality of the substrate media, free from velocity disturbances or discontinuities, is necessary to achieve high quality image production. However, the transfer of the substrate media from the marking zone transport mechanism to a downstream transport mechanism can introduce disturbances to the motion quality, which can result in unwanted image artifacts on the document.

One potential solution is to introduce an intentional buckle in the substrate media during transport. In this way, any disturbances to motion quality can be absorbed by the buckle, with the flat portion of the substrate media generally undisturbed. Unfortunately, this technique is only applicable with lightweight media types, particularly those which can be buckled without causing permanent damage to the media substrate. This technique is not compatible with heavier and stiffer substrate media, including for example paperboard up to between about 26 and 29 point (i.e., about 0.026-0.029 in. thickness). Therefore, a solution compatible with many types of substrate media is desired.

SUMMARY

In order to overcome these and other weaknesses, drawbacks, and deficiencies in the known art, provided according to the present disclosure is a media transport apparatus, including a first media transport, having a first transport surface and a first drive unit, the first media transport configured and operative to convey the substrate media. A second media transport having a second transport surface and a second drive unit receives the substrate media from the first media transport and conveys the substrate media. A first force transducer measures a first relative force between the first and second media transports, and outputs a first force signal associated with the first relative force. A control unit receives the first relative force signal, and outputs a control signal to at least one of the first and second drive units that is dependent upon a comparison of the first relative force signal with a predetermined value. The control signal commands the respective first or second drive unit to drive the motion of the respective first or second media transport to maintain the force signal at or about no greater than about the predetermined value.

In the media transport apparatus according to the present disclosure, the first force transducer may comprise a load cell strain gauge. The first force transducer is optionally operative to measure a component of the first relative force generally aligned with a process direction of the first or second media transports.

At least one of the first and second media transports are optionally mounted to a respective chassis body, and the first force transducer is mounted to interface with the chassis body. A friction-reducing mounting optionally supports the second transport apparatus, configured to provide at least one degree of freedom generally aligned with a process direction of the second transport apparatus.

Optionally, at least one of the first and second transports are operative to generate respective first or second hold down forces hold the substrate media to respective first and second transport surfaces. The first or second hold down forces may be generated by any of an air pressure differential, an electrostatic field, or a combination thereof.

In certain embodiments, a motion encoder is operatively connected with at least one of the first transport surface and the substrate media thereon, the first motion encoder being configured and operative to output a first motion signal associated with the motion of the first transport surface or the substrate media.

According to a further embodiment of the present disclosure, a third media transport having a third transport surface and a third drive unit is configured and operative to receive the substrate media from the second media transport and to convey the substrate media. A second force transducer measures a relative force between the second and third media transports, and outputs a second force signal associated with the second relative three. The control signal output by the control unit commands the respective first or second drive unit to drive the motion of the respective first or second media transport to maintain a difference between the first force signal and the second force signal at or about no greater than about a predetermined value. The third media transport may include a friction-reducing mounting supporting it, the friction-reducing mounting providing at least one degree of freedom generally in the process direction of the third media transport.

Also provided according to the present disclosure is a media transport method, in which a substrate media is conveyed from a first media transport having a first transport surface and a first drive unit, to a second media transport having a second transport surface and a second drive unit. A first relative force between the first and second media transports is measured, and a first force signal associated with the first relative force output. The first force signal is received in a control unit, which in turn outputs a control signal to at least one of the first and second drive units that is dependent upon a comparison of the first relative force signal with a predetermined value. The control signal commands the respective first or second drive unit receiving the control signal to drive the motion of the respective first or second media transport to maintain the force signal at or about no greater than about the predetermined value.

In further embodiments of the present disclosure, at least one of the first and second media transports is mounted to a chassis body, the first force transducer is mounted to interface with the chassis body. The first force transducer may measure a component of the first relative force generally aligned with a process direction of the first or second media transports. The second transport apparatus may be optionally supported by a friction-reducing mount configured to provide at least one degree of freedom generally aligned with a process direction of the second transport apparatus.

The first or second media transports may generate a respective first or second hold down force operative to hold the substrate media to respective first and second transport surfaces, for example by an air pressure differential, an electrostatic field, or a combination thereof. A first motion encoder is optionally connected with at lest one of the first transport surface and the substrate media thereon, and outputs a first motion signal associated with the motion of the first transport surface or the substrate media from the first motion encoder.

In still further embodiments, the substrate media may be further conveyed from the second media to a third media transport having a third transport surface and a third drive unit. A second relative three between the second and third media transports is measured, and a second force signal associated with the second relative force is output to the control unit. The control signal output by the control unit commands the respective first or second drive unit to drive the motion of the respective first or second media transport to maintain a difference between the first force signal and the second force signal at or about no greater than about the predetermined value. The third transport apparatus may be optionally supported by a friction-reducing mount configured to provide at least one degree of freedom generally aligned with a process direction of the third transport apparatus.

These and other purposes, goals and advantages of the present application will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings, in which like reference numerals refer to like structures across the several views, and wherein.

DETAILED DESCRIPTION

Introduction

As used herein, a "printer" refers to any device, machine, apparatus, and the like, for forming images on substrate media using ink, toner, and the like, A "printer" can encompass any apparatus, such as a copier, bookmaking machine, facsimile machine, multi-function machine, etc., which performs a print outputting function for any purpose. Where a monochrome printer is described, it will be appreciated that the disclosure can encompass a printing system that uses more than one color (e.g., red, blue, green, black, cyan, magenta, yellow, clear, etc.) ink or toner to form a multiple-color image on a substrate media.

As used herein, "substrate media" refers to a tangible medium, such as paper (e.g., a sheet of paper, a long web of paper, a ream of paper, etc.), transparencies, parchment, film, fabric, plastic, paperboard up to between about 26 and 29 point (i.e., about 0.026-0.029 in. thickness) or other substrates on which an image can be printed or disposed.

As used herein "process path" refers to a path traversed by a unit of substrate media through a printer to be printed upon by the printer on one or both sides of the substrate media. A unit of substrate media moving along the process path from away from its beginning and towards its end will be said to be moving in the "process direction".

As used herein, "transport" when used as a noun, "media transport" or "transport apparatus", each and all refer to a mechanical device operative to convey a substrate media through a printer to be marked with an image.

Description

Figure 1:
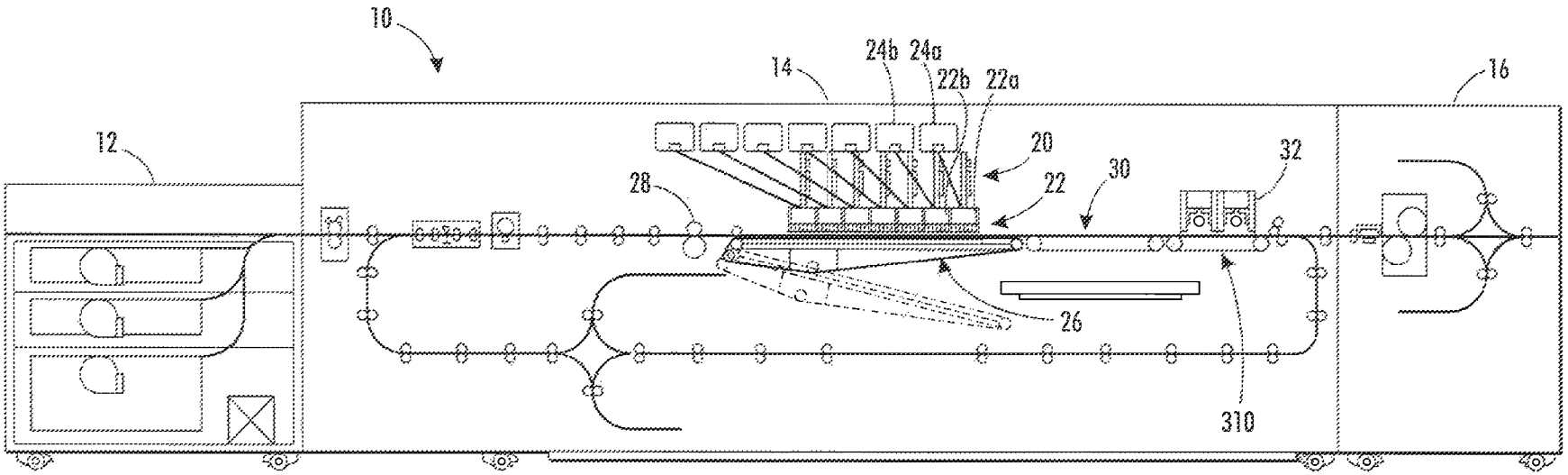
FIG. 1 illustrates a printer according to an exemplary embodiment of the present disclosure.

Referring now to FIG. 1, illustrated is a printer, generally 10, according to a first embodiment of the present disclosure. The printer 10 may include a media feeding unit 12 in which one or more types of substrate media may be stored and from which the substrate media may be fed, for example sheet-by-sheet feeding of a cut sheet medium, to be marked with an image. The media feeding unit 12 delivers substrate media to a marking unit 14. The marking unit delivers marked substrate media to an interface module 16 which may, for example, prepare the substrate for a finishing operation. Optionally the printer 10 may include a finishing unit (not shown), which receives printed documents from the interface module 16. The finishing unit, for example, finishes the documents by stacking, sorting, collating, stapling, hole-punching, or the like.

Marking unit 14 includes a marking zone, generally 20 within the marking unit 14. A marking zone 20 encompasses a marking engine, in this example an ink jet marking engine having one or more print heads 22*a*, 22*b*, etc., collectively print heads 22, any of which are operative to directly mark the substrate media and thereby form an image on the substrate media. One technology, as an example only, employable in a print head 22*a* is an ink jet print head configuration. The ink jet print head may draw ink from a reservoir 24*a*, 24*b*, etc. A marking zone transport 26 is operative to hold a substrate media to itself securely, for example by electrostatic means or vacuum means, without limitation. In other embodiments, the marking engine may comprise any technology for printmaking or document creation, including electrostatic (xerographic) transfer, or more colloquially laser-printing.

The marking zone transport 26 is further operative to receive a substrate media delivered towards the marking zone 20, for example by roller nips 28, and to convey the substrate media towards, into, through, out of, and/or away from the marking zone 20, with positive control of the motion of the substrate media. The marking zone transport 26 maintains the substrate media within the marking zone 20 in sufficient proximity to the print heads 22 to permit them to mark the substrate media, but prevents the media from contacting the print heads.

The marking zone transport 26 is configured and operative to pass the substrate media to a downstream transport 30 for further handling. As example only, the downstream transport 30 would receive the substrate media from the marking zone transport 26 and deliver the substrate media to be subjected to a post-marking process 32, including without limitation ultraviolet light curing, fusing, spreading, drying, etc., any or some combination of which may be included without departing from the scope of the instant disclosure. The post-marking process 32 may of course be omitted, if desired.

In the embodiment of the present disclosure described herein, the substrate media transports 26, 30 between which motion is coordinated are both resident within the printing unit 14. However, it will be appreciated by those skilled in the art, in light of the present disclosure, that the disclosure may be implemented to pass substrate media between adjacent transports within or among any of the media feeding unit 12, the marking unit 14, or the handling unit 16, or substantially any other unit in which substrate media is transported, all without departing from the scope of Applicants' present disclosure.

Figure 2:
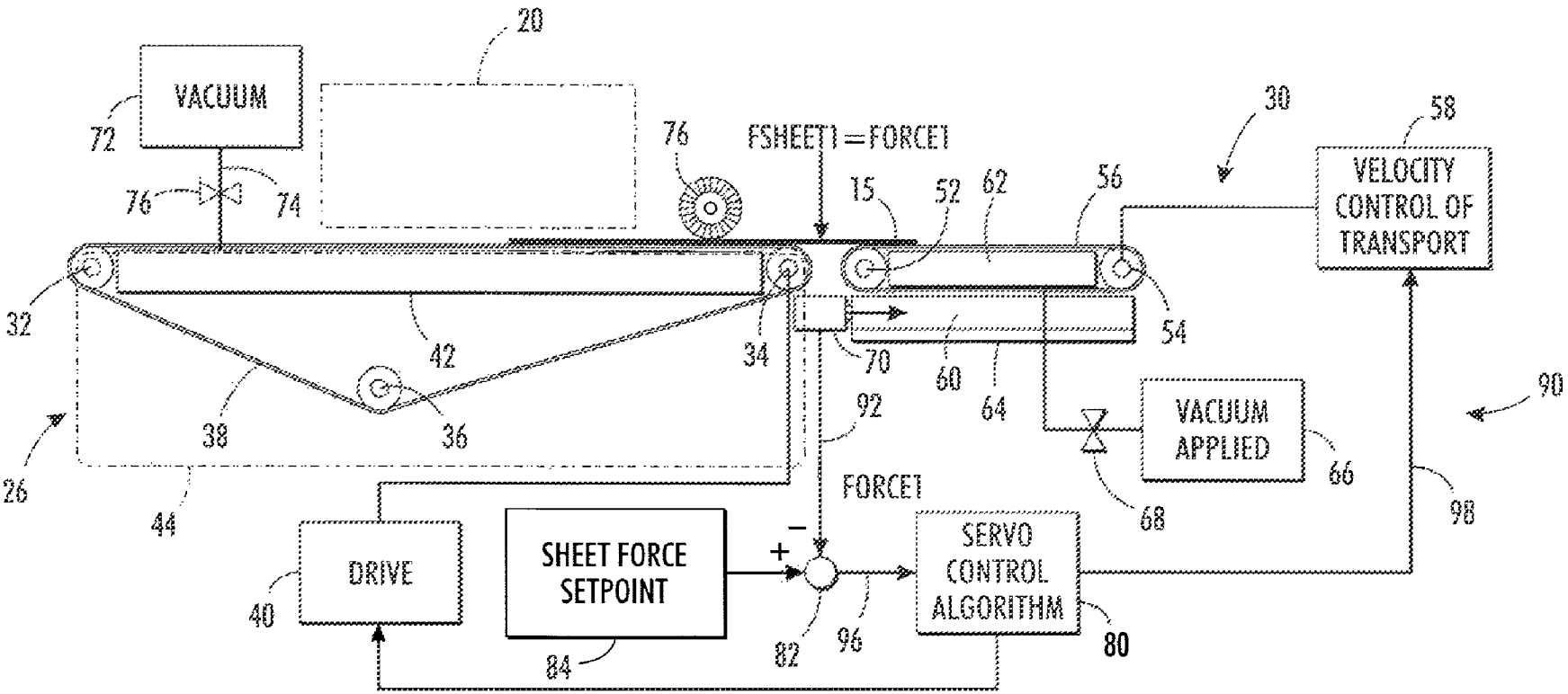
FIG. 2 illustrates schematically the motion control scheme for a substrate media.

Referring now to FIG. 2, illustrated schematically is the motion control scheme for substrate media passing between the marking zone transport 26, and the downstream transport 30. Marking zone transport 26 includes an endless belt 38 and a path around rollers 32, 34, and 36. In this case, roller 34 served as a drive roller, roller 36 a tensioning roller, and roller 324 a steering roller. Note: update FIG. 2, drive bod needs to be connected to roller 34. Other configurations will be seen as within the scope of the present disclosure to one skilled in the art. A marking zone transport drive unit 40 controls the motion of the drive roller 34 by commanding a motor (not shown) operatively connected with the drive roller 34. The endless belt 38 in certain embodiments is air-permeable, and a vacuum hold-down manifold 42 is positioned beneath the endless belt 38 where the endless belt 38 passed beneath the print heads 22, i.e., the endless belt lies at least in part between the vacuum hold-down manifold 42 and the print heads 22. The vacuum hold-down manifold 42 introduces a negative atmospheric pressure at its top surface, which in turn draws air through the air-permeable endless belt 384. A unit of substrate media lying on the endless belt 384 is drawn against the endless belt 384 by the air flow which passes through the endless belt 34 and the vacuum hold-down manifold 42, and also by the air pressure differential between opposing sides of the substrate media 15. The vacuum hold-down manifold 42 is in fluid communication with a source of negative vacuum air pressure 72 via line 74. Flow through line 74 may be optionally controlled or varied, for example by provision of a flow control valve 76, pressure regulator, or the like. Alternately, vacuum source 72 may itself be configured to provide variable vacuum pressure. The print zone transport 26 is mounted by, on or to a frame or chassis portion 44 of the marking unit 14.

Further illustrated in FIG. 2 is a downstream transport 30. In the present example, downstream transport 30 also employs and endless belt 56 and a path around a plurality of rollers 52, 54, two in the case of the present example, though three or more, similar with print zone transport 26, may be optionally be employed. At least one roller, e.g., 54 of the downstream transport 30 is a drive roller, with others of the rollers, e.g., 52 being an idler(s) and/or steering roller. A downstream transport drive unit 58 controls the motion of the drive roller 54 by commanding a motor (not shown) operatively attached to drive roller 54, in the present example, endless belt 56 is also an air-permeable endless belt, and the downstream transport 30 is provided with a vacuum hold-down manifold 62 beneath at least a portion of the endless belt 56.

Furthermore, it will be appreciated that alternate whole-down means, for example an electrostatic hold-down system as known in the art, may be used in connection with the marking zone transport 26 and/or downstream transport 30 in addition to, or in place of the respective vacuum hold-down manifolds 42-62, without departing from the scope of the present disclosure.

The downstream transport 30 is mounted to or supported by a chassis frame 60. The chassis frame 60 is further optionally connected with the marking unit 14 via a friction-reducing slide 64, with at least one degree of freedom aligned with a processed direction that substrate media 15 moves through the printer 10. Optional slide 64 may be for example a linear slide, including a linear ball bearing slide, or may provide additional degrees of freedom, for example means for supporting chassis frame 60 on a fluid film, for example oil, which would give freedom of motion to the chassis frame 60 in both a processed direction, and laterally with the processed direction.

The interface between the downstream transport chassis 60 and the frame or chassis 44 upon which the print zone transport 26 is mounted is monitored by a force transducer 70. Force transducer 70 may be a strain gauge, load cell, or other means for measuring and/or determining the force between downstream chassis 60 and print zone transport chassis 44. The downstream transport 60 will be isolated, including via optional slide 64, such that any relative force between the downstream transport 30 and print zone transport 26 will be detectable by force transducer 70.

In an alternative embodiment, downstream transport 30 is not mounted to a slide 64, but directly to a chassis 60. Chassis 60 may be in turn supported on the frame 44 in a way that the relative force between the two is determinable by force transducer 70. As example only, a pivotal connection may exist between frame 44 and chassis 60, combined with the force transducer at a second point of interface between the frame 44 and the chassis 60. Appropriate calculations would be made to account for the gravitational component of the forces between frame 44 and chassis 60.

In operation, it is desirable that there shall be no interruptions or disturbances to the motion quality of substrate media 15 as it passes adjacent the print zone 20 and from the print zone transport 26 to the downstream transport 30. One source of motion disturbances may be speed mismatch between the two transports. In that case, as the downstream transport exerts force upon the substrate media 15, the speed mismatch will be manifest as a force or tugging on the substrate media 15, ultimately culminating in disturbances to the motion quality, for example, constant speed nature of the motion, of the substrate media 15 through the print zone 20. As the force grows, the substrate media may slip which results in image distortion and/or undesirable artifacts.

Therefore, a control system, generally 90 is established using an output signal 92 from the source transducer 70 as feedback data. A sheet force set point 84 is established. Typically 0 though some level of force may be desirable, with a signal representing the sheet force set point delivered to a summing junction 82 together with the signal 92 from the force transducer 70. The output of the sum injunction 96 is transmitted to a controller 80, including a proportional-integral-derivative (PID) control algorithm for determining the velocity of one or both of the print zone transport 26 and downstream transport 30. The controller 80 outputs a control signal 98 which is directed towards drive unit 58 for control of the downstream transport drive roller 54. Alternately, or additionally, the controller 80 may transmit a signal 949 to print zone transport drive unit 40, for control of the print zone transport drive roller 34. In this way, the force feedback control maintains speed matching between the two transport units.

Figure 3A:
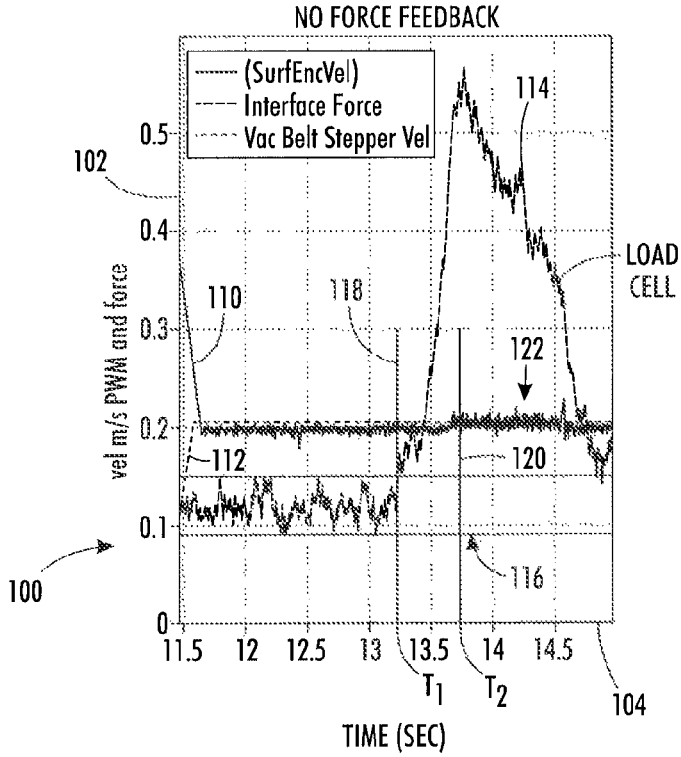
FIGS. 3A and 3B graph data derived from an experimental implementation of a system consistent with the present disclosure.
Figure 3B:
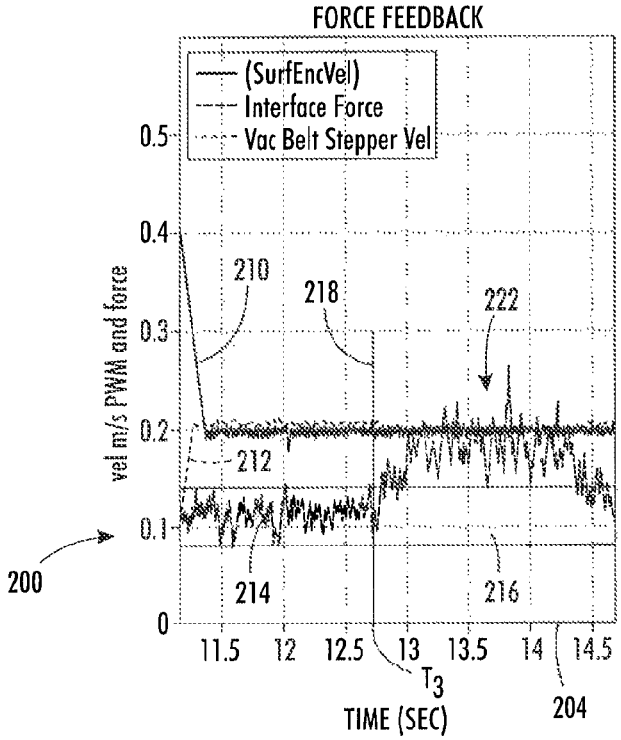

Referring now to FIGS. 3*a* and 3*b*, illustrated are data derived from an experimental implementation of a force feedback system generally consistent with the present disclosure. In FIG. 3*a*, graph 100 is defined by a vertical dependent axis 102 which measures alternately velocity in meters per second and force in Newtons according to the data plot, as will be explained in further detail below. Independent horizontal axis 104 depicts time in seconds from a base line initiation of the print making process.

Line 110 of the graph 100 represents data derived from a surface encoder (rotary surface encoder 76, FIG. 2) indicated a surface velocity of the substrate media 15 in the print zone 20. Data line 112 indicates a stepper velocity of a stepper motor driving the vacuum belt of downstream transport 30. In this case, the stepper velocity 112 is controlled as constant. Data line 114 indicates an interface force between chassis frame 60 and frame 44 as measured by force transducer 70. As illustrated in the graph 100, the interface force 114 fluctuates generally within a nominal band 116 until the sheet media 15 bridges the gap between the transports 26, 30 indicated that time $T_1$, generally vertical line 118. From the time of interface, the interface force 114 grows sharply, reaching a peak at time $T_2$, indicated by vertical line 120. At our about the peak of interface force 114, disturbance in the surface velocity 110 of the substrate media 115 is indicated, generally at 122. The decrease in interface force 115 from its peak is a result of slippage in the substrate media, which slippage is manifest in the disturbances to motion quality at 122.

Referring then to FIG. 3*h*, illustrated is a graph, generally 200 having vertical dependent axis 202, and horizontal independent axis 204 that are analogous to there counterparts in graph 100 of FIG. 3*a*. Surface encode of velocity is indicated by data line 210, stepper velocity of the vacuum belt driver motor is indicated by data line 212, and interface force indicated by data line 214. Graph 200, and the experiment from it is derived, differs from the prior example in that the vacuum belt stepper velocity 212 is not held constant at a presumed speed of the print zone transport 26. Rather, the vacuum belt stepper velocity 212 is controlled according to force feedback system 90 illustrated at FIG. 2. In this case, interface force 214 fluctuates within a nominal band 216, generally analogous to the prior example. The substrate media 15 interfaces the downstream transport at time $T_3$ indicated by vertical line 218. In the example of FIG. 3*b* however, stepper velocity 212 is controlled by controller 80 in accordance with the force feedback or force transducer 70 as the interface force 214 rises, the stepper velocity 212 is allowed to decrease, to control the interface force 214 below the level seen in the prior example. As a result, and with reference generally to 222, the surface encoder velocity 210 remains substantially constant without the motion quality disturbances exhibited in the prior example, owing to the greatly reduced interface force 214.

Figure 4:
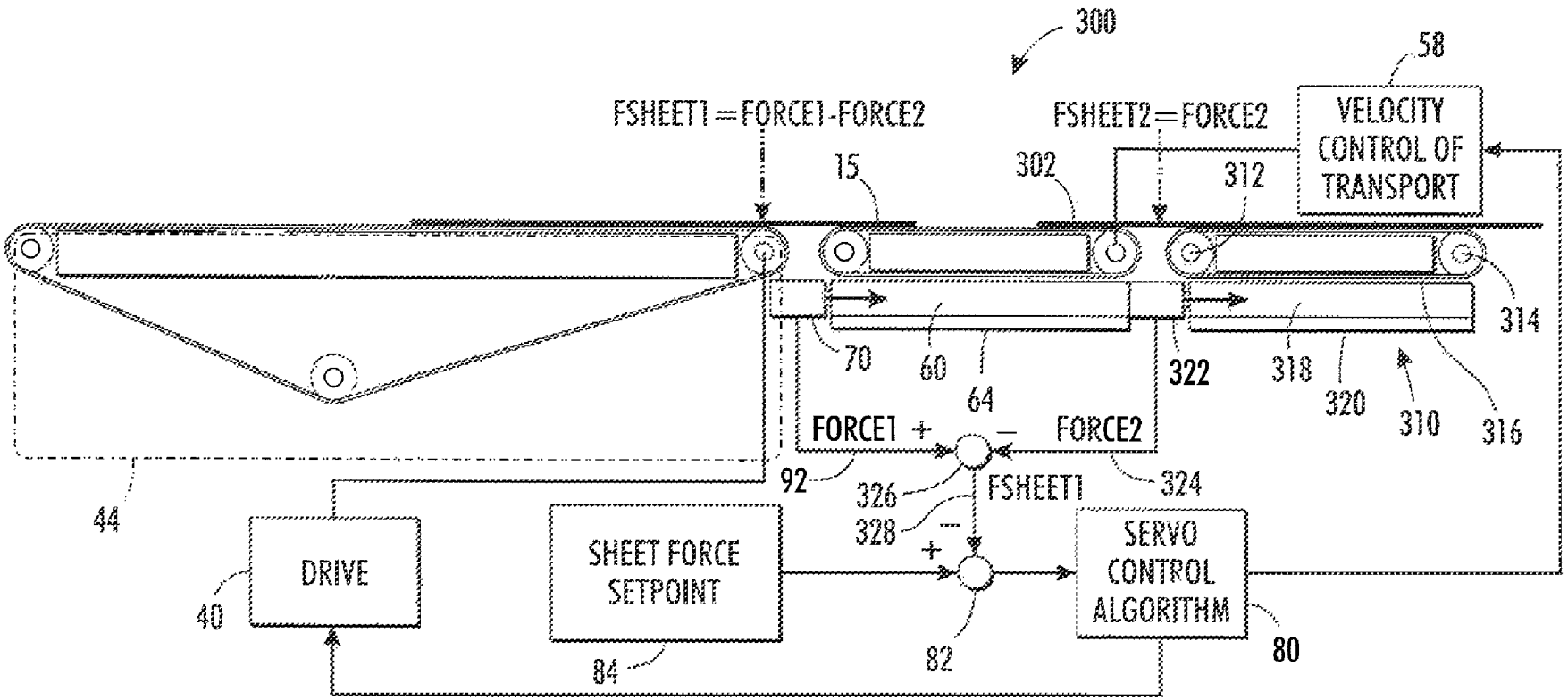
FIG. 4 illustrates an alternate embodiment of the motion control scheme for substrate media according to the present disclosure.

Referring now to FIG. 4, illustrated is an alternate embodiment of the present disclosure. In particular, the embodiment of FIG. 4 includes a further downstream transport 310. For simplicity of discussion, downstream transport 310 is substantially analogous to downstream transport 30, for example having rollers 312, 314, at least one of which is a driven roller, the other being an idler and/or steering roller, and an endless belt 316 and a path around rollers 312, 314. The downstream transport 310 is mounted to and carried by chassis frame 318, which itself is optionally mounted to a slide 320 having at least one degree of freedom in the process direction.

A second force transducer 322 is installed between the downstream frame chassis 318 and downstream frame chassis 60. A signal 324 output from the force transducer 322 is subtracted from the signal 42 emanating from force transducer 70 in summing junction 326. In this way, the signal 328 is input to summing junction 82 as the feedback source. In this way, the feedback control of drive unit 58 accounts solely for forces attributed to downstream transport 30. The feedback force does not attempt to compensate using drive 58 for speed mismatch forces that are attributable to downstream units. Therefore, there is no unintentional buckle initiated by an over slowing of the transport 30 when the force is attributable to downstream transport 310.

With reference to the above discussion of the first force transducer 70, similar variation in physical interface between the first downstream transport 30, the second downstream transport 310, optional respective chassis thereof, and second force transducer 322 are contemplated within the scope of the present disclosure. For example, suitable preload calculation and normalization will permit the effective force measurement to be determined without the structure, cost and expense of a friction-reducing slide 320.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A media transport apparatus comprising:

a first media transport having a first transport surface and a first drive unit, the first media transport configured and operative to convey a substrate media;

a second media transport having a second transport surface and a second drive unit, the second media transport configured and operative to receive the substrate media from the first media transport and to convey the substrate media;

a first force transducer operative to measure a first relative force between the first and second media transports, and to output a first force signal associated with the first relative force;

a control unit configured and operative to receive the first relative force signal, and to output a control signal to at least one of the first and second drive units that is dependent upon a comparison of the first relative force signal with a predetermined value, the control signal commanding the respective first or second drive unit to drive the motion of the respective first or second media transport to maintain the force signal at or about no greater than the predetermined value.

2. The media transport apparatus according to claim 1, wherein the at least one of the first and second media transports are mounted to a respective chassis body, and the first force transducer is mounted to interface with the chassis body.

3. The media transport apparatus according to claim 1, wherein the first force transducer comprises a load cell strain gauge.

4. The media transport apparatus according to claim 1, further comprising a friction-reducing mounting supporting the second transport apparatus, configured to provide at least one degree of freedom generally aligned with a process direction of the second transport apparatus.

5. The media transport apparatus according to claim 1, wherein at least one of the first and second transports are operative to generate respective first and second hold down forces hold the substrate media to respective first and second transport surfaces.

6. The media transport apparatus according to claim 5, wherein the first or second hold down forces are generated by an air pressure differential, an electrostatic field, or a combination thereof.

7. The media transport apparatus according to claim 1, further comprising:

a first motion encoder operatively connected with at least one of the first transport surface and the substrate media thereon, the first motion encoder configured and operative to output a first motion signal associated with the motion of the first transport surface or the substrate media.

8. The media transport apparatus according to claim 1, wherein the first force transducer is operative to measure a component of the first relative force generally aligned with a process direction of the first or second media transports.

9. The media transport apparatus according to claim 1, further comprising:

a third media transport having a third transport surface and a third drive unit, the third media transport configured and operative to receive the substrate media from the second media transport, to hold the substrate media to the third transport surface and to convey the substrate media;

a second force transducer operative to measure a relative force between the second and third media transports, and to output a second force signal associated with the second relative force; and the control signal output by the control unit commands the respective first or second drive unit to drive the motion of the respective first or second media transport to maintain a difference between the first force signal and the second force signal at or about no greater than the predetermined value.

10. The media transport apparatus according to claim 9, further comprising a friction-reducing mounting supporting the third media transport, configured to provide at least one degree of freedom generally in the process direction of the third media transport.

11. The media transport apparatus according to claim 1, wherein at least one of the first or second media transports comprises a flexible belt routed over one or more rollers, the flexible belt being moved under the influence of the respective first or second drive unit, and the respective first or second media transport surface comprises a surface of the flexible belt.

12. The media transport apparatus according to claim 11, wherein the flexible belt is air-permeable, whereby a negative air-pressure introduced on a first side of the flexible belt induces a hold-down force on the substrate media carried on a second side of the flexible belt opposite the first side.

13. A printer comprising a marking engine operative to mark an image on a substrate media;

a first media transport having a first transport surface and a first drive unit, the first media transport configured and operative to convey a substrate media through or adjacent to the marking engine to be marked with an image;

a second media transport having a second transport surface and a second drive unit, the second media transport configured and operative to receive the substrate media from the first media transport and to convey the substrate media;

a first force transducer operative to measure a first relative force between the first and second media transports, and to output a first force signal associated with the first relative force;

a control unit configured and operative to receive the first relative force signal, and to output a control signal to at least one of the first and second drive units that is dependent upon a comparison of the first relative force signal with a predetermined value, the control signal commanding the respective first or second drive unit to drive the motion of the respective first or second media transport to maintain the force signal at or about no greater than the predetermined value.

14. The printer according to claim 13, wherein the marking engine comprises at least one of an ink jet marking engine, a xerographic marking engine, and a transfix marking engine.

15. The printer according to claim 13, wherein the at least one of the first and second media transports are mounted to a respective chassis body, and the first force transducer is mounted to interface with the chassis body.

16. The printer according to claim 13, wherein the first force transducer comprises a load cell strain gauge.

17. The printer according to claim 13, further comprising a friction-reducing mounting supporting the second transport apparatus, configured to provide at least one degree of freedom generally aligned with a process direction of the second transport apparatus.

18. The printer according to claim 13, wherein at least one of the first and second transports are operative to generate respective first and second hold down forces hold the substrate media to respective first and second transport surfaces.

19. The printer according to claim 18, wherein the first or second hold down forces are generated by an air pressure differential, an electrostatic field, or a combination thereof.

20. The printer according to claim 13, wherein the first force transducer is operative to measure a component of the first relative force generally aligned with a process direction of the first or second media transports.

21. The printer according to claim 13, further comprising:

a third media transport having a third transport surface and a third drive unit, the third media transport configured and operative to receive the substrate media from the second media transport, to hold the substrate media to the third transport surface and to convey the substrate media;

a second force transducer operative to measure a relative force between the second and third media transports, and to output a second force signal associated with the second relative force; and the control signal output by the control unit commands the respective first or second drive unit to drive the motion of the respective first or second media transport to maintain a difference between the first force signal and the second force signal at or about no greater than the predetermined value.

22. The printer according to claim 21, further comprising a friction-reducing mounting supporting the third media transport, configured to provide at least one degree of freedom generally in the process direction of the third media transport.

23. The printer according to claim 13, wherein at least one of the first or second media transports comprises a flexible belt routed over one or more rollers, the flexible belt being moved under the influence of the respective first or second drive unit, and the respective first or second media transport surface comprises a surface of the flexible belt.

24. The printer according to claim 23, wherein the flexible belt is air-permeable, whereby a negative air-pressure introduced on a first side of the flexible belt induces a hold-down force on the substrate media carried on a second side of the flexible belt opposite the first side.

25. A media transport method comprising:

conveying a substrate media from a first media transport having a first transport surface and a first drive unit, to a second media transport having a second transport surface and a second drive unit;

measuring a first relative force between the first and second media transports, and outputting a first force signal associated with the first relative force;

receiving the first force signal in a control unit, the control unit further outputting a control signal to at least one of the first and second drive units that is dependent upon a comparison of the first relative force signal with a predetermined value; and commanding the respective first or second drive unit receiving the control signal to drive the motion of the respective first or second media transport to maintain the force signal at or about no greater than the predetermined value.

26. The media transport method according to claim 25, further comprising:

mounting at least one of the first and second media transports to a chassis body; and mounting the first force transducer is to interface with the chassis body.

27. The media transport method according to claim 25, further comprising:

supporting the second transport apparatus by a friction-reducing mount configured to provide at least one degree of freedom generally aligned with a process direction of the second transport apparatus.

28. The media transport method according to claim 25, further comprising:

generating a respective first and second hold down force operative to hold the substrate media to respective first and second transport surfaces.

29. The media transport method according to claim 28, wherein the first or second hold down forces being generated by an air pressure differential, an electrostatic field, or a combination thereof.

30. The media transport method according to claim 25, further comprising:

operatively connecting a first motion encoder with at least one of the first transport surface and the substrate media thereon; and outputting a first motion signal associated with the motion of the first transport surface or the substrate media from the first motion encoder.

31. The media transport method according to claim 25, further comprising:

measuring a component of the first relative force generally aligned with a process direction of the first or second media transports with the first force transducer.

32. The media transport method according to claim 25, further comprising:

conveying the substrate media from the second media to a third media transport having a third transport surface and a third drive unit;

measuring a second relative force between the second and third media transports, and outputting a second force signal associated with the second relative force;

receiving the second force signal in the control unit; and wherein the control signal output by the control unit commands the respective first or second drive unit to drive the motion of the respective first or second media transport to maintain a difference between the first force signal and the second force signal at or about no greater than the predetermined value.

33. The media transport method according to claim 32, further comprising:

supporting the third transport apparatus by a friction-reducing mount configured to provide at least one degree of freedom generally aligned with a process direction of the third transport apparatus.

* * * * *